United States Patent [19]

Bartels et al.

[11] 3,992,976

[45] Nov. 23, 1976

[54] LIQUID PROPELLANT GUN

[75] Inventors: Bruce Bartels; John W. Holtrop; Larry L. Liedtke; Russell T. Trovinger, all of Ridgecrest, Calif.

[73] Assignee: The United States of America as represented by the Secretary of the Navy, Washington, D.C.

[22] Filed: Sept. 12, 1975

[21] Appl. No.: 612,817

[52] U.S. Cl. ..... 89/7; 89/11

[51] Int. Cl.[2] ..... F41F 1/04

[58] Field of Search ..... 89/7, 11, 26; 137/509, 137/506

[56] References Cited

UNITED STATES PATENTS

| | | | |
|---|---|---|---|
| 2,981,153 | 4/1961 | Wilson et al. | 89/7 |
| 3,138,990 | 6/1964 | Jukes et al. | 89/7 |
| 3,763,739 | 10/1973 | Tassie | 89/7 |
| 3,782,241 | 1/1974 | Ashley | 89/7 |
| 3,888,159 | 6/1975 | Elmore et al. | 89/7 |
| 3,915,057 | 10/1975 | Broxholm et al. | 89/7 |

*Primary Examiner*—David H. Brown

*Attorney, Agent, or Firm*—R. S. Sciascia; Roy Miller; Gerald F. Baker

[57] ABSTRACT

An injection system for a liquid propellant gun including coaxial flow valves giving complete mixing of two propellant components by convergent streams, wherein ullage is eliminated by closely contouring the valves with the gun chamber and the flow valves are automatically controlled by action of the propellant pump.

20 Claims, 7 Drawing Figures

LIQUID PROPELLANT GUN

BACKGROUND OF THE INVENTION

This invention relates to a liquid propellant gun and more specifically to an injection system for a propellant gun and most particularly to a concentric valve arrangement for fuel and oxidizer injection characterized by zero ullage, elimination of back pressure in the injector and automatic valve operation.

Known prior art liquid propellant guns do not have zero ullage. When the fuel does not completely fill the gun chamber, ignition and interior ballistics become less predictable because ullage promotes erratic burning and large pressure excursions resulting ultimately in gun damage. In some prior art devices the injectors develop a swirl in the fluid column which tends to concentrate gas bubbles at the center of the fluid column further contributing to erratic burning of the propellant.

Some previous designs have used conventional carburetion to produce a fuel air mixture as the propellant. The carburetion method requires a much larger volume of propellant for a given amount of energy in comparison to the liquid fuel and oxidizer usable with the present invention. Furthermore, the carburetion system requires a source of air which would not be readily available if the gun were in an application in the upper atmosphere or further out in space.

Other prior art weapons have suffered from other drawbacks such as complex linkages to control the propellant valve, breech pressure acting on valve components and obturating seals being damaged by passing over valve parts or inlet ports.

SUMMARY OF THE INVENTION

The injection system according to the present invention provides zero ullage fuel injection, complete mixing of propellant components and elimination of seal damage. Complete mixing of propellant components is achieved by the convergent streams of fuel and oxidizer, for example, coming from co-axial flow valves. No ullage is introduced into the gun chamber and seal damage is practically eliminated because the flow valves are contoured for a smooth fit with the gun chamber.

With the arrangement according to the invention, large flow areas can be developed without sacrificing chamber strength and the flow valves are automatically controlled by action of the propellant pump.

The gun bolt and injector are syncronized, for example, by a cam follower, cam, and connecting link system and the fuel pump is automatically braked at the end of its stroke by the increased pumping pressure generated when the co-axial valves close.

DESCRIPTION AND OPERATION

Figure 1:
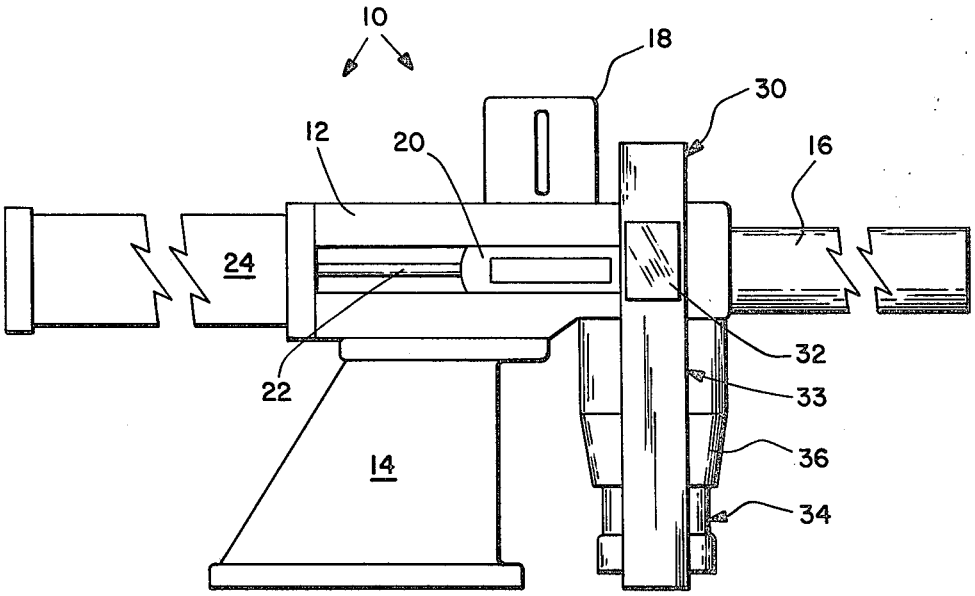
FIG. 1 is a side elevation of a liquid propellant gun according to the invention.

A liquid propellant gun according to the present invention is constructed as an integral composite block generally designated by the numeral 10 in FIG. 1. A rearward section or receiver 12 surmounts a base 14 and is provided with a forward section characterized by barrel 16 and an intermediate section comprising a magazine 18. Within the receiver 12 is shown the bolt 20 and the bolt driver 22 which is operated from fluid actuator 24. The bolt 20 carries a cam follower 26, better shown in FIG. 2.

Forward of the receiver 12, within the intermediate section is an operating mechanism 30 which carries a cam 32 on a yoke 33 for cooperation with the cam follower 26 on bolt 20. The yoke 33 also carries a piston assembly 34 for cooperation with a cylinder assembly 36 as will be described below.

Figure 2:
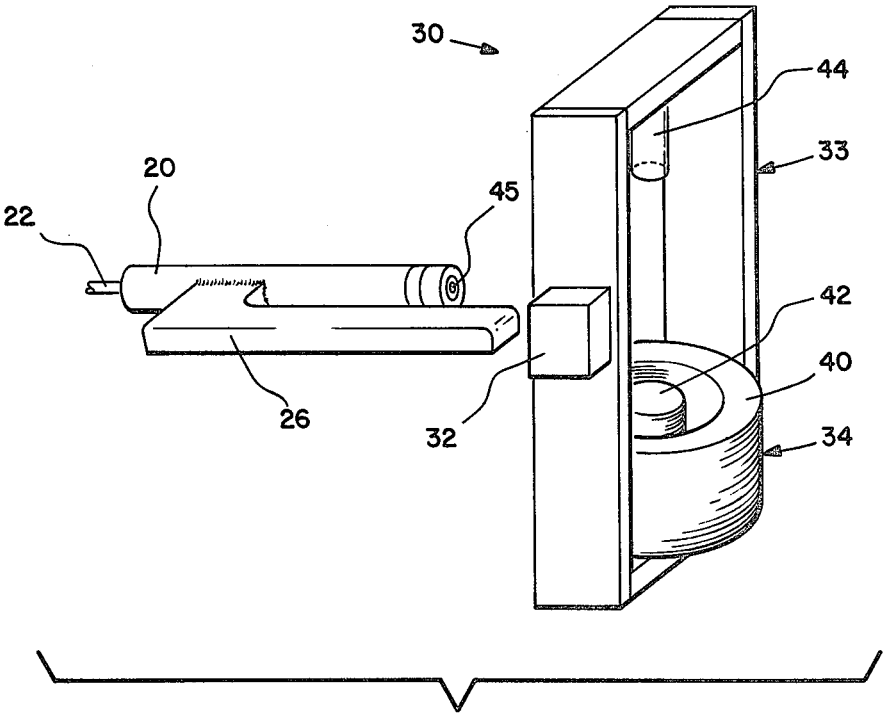
FIG. 2 is a schematic representation of selected parts of FIG. 1 showing the cam and cam follower arrangement.
Figure 3:
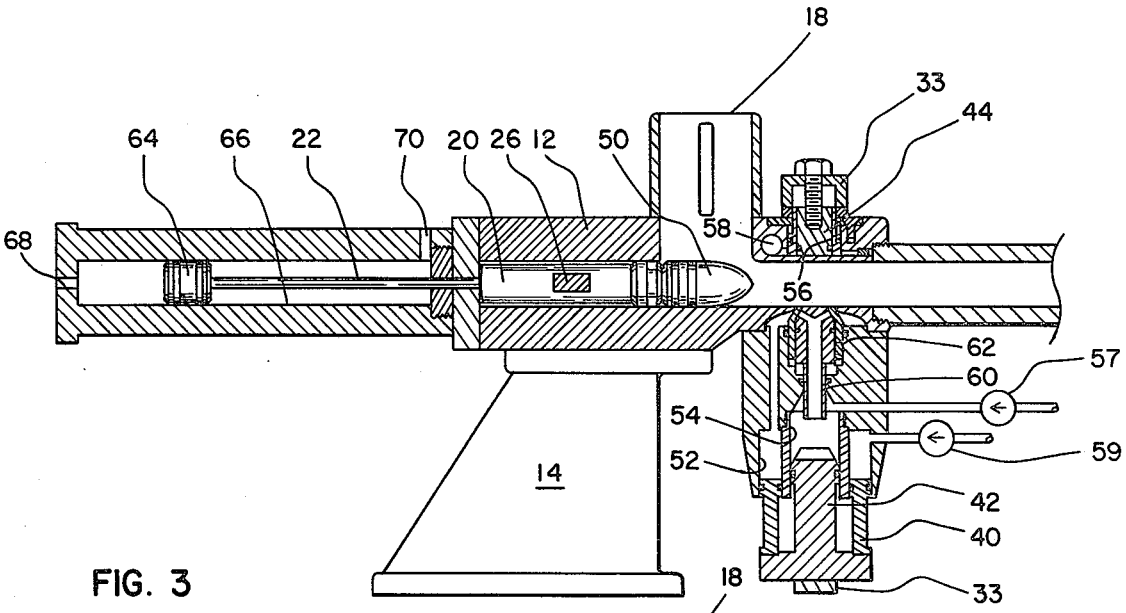
FIG. 3 is a longitudinal cross-sectional view of the gun of FIG. 1.

FIG. 2 illustrates the cooperation of cam follower 26 on bolt 20 in cooperation with the cam 32 on yoke 33. The yoke 33 is designed to be moved upward by piston 44 as will be more clearly shown in FIG. 3. When the yoke 33 is moved upwardly as shown in FIG. 2 the annular piston 40 and the cylindrical piston 42 cooperate with their respective cylinders as shown in FIG. 3 and the cam 32 is moved out of the path of cam follower 26 to allow the bolt 20 to be moved forward by the bolt driver 22. Also shown in FIG. 2 is a spark ignitor 45 at the forward face of bolt 20. The operation of the various parts mentioned above may be readily visualized by viewing the longitudinal cross-sectional view shown in FIG. 3. In this view, the yoke 33 is shown in its lowermost position, bolt 20 is in its rear most position and a projectile has been inserted in front of the bolt through magazine 18.

In FIG. 3, the yoke 33 is its lower most position with pistons 40 and 42 shown in their respective cylinders 52, 54.

Operating piston 44 is also shown in its lower most position in cylinder 56. Hydraulic fluid is supplied to operating cylinder 56 through a port 58.

Figure 4:
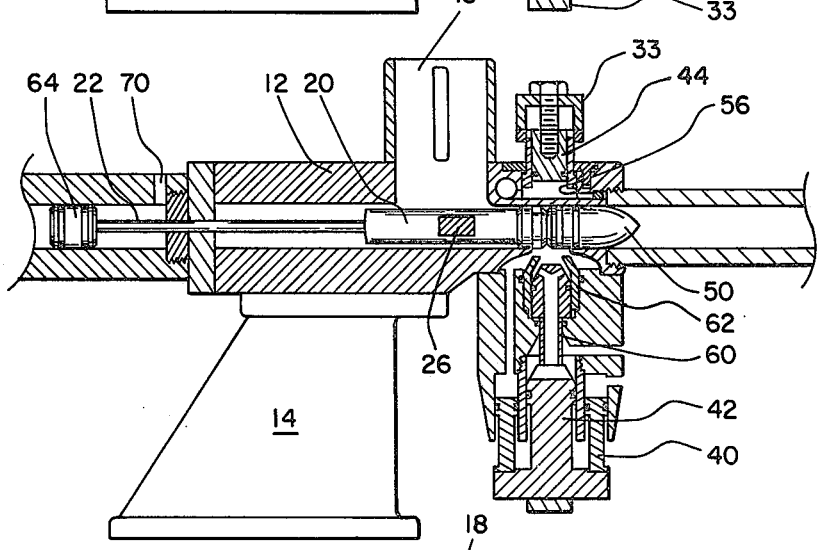
FIG. 4 is a longitudinal cross-sectional view similar to FIG. 3 with the bolt in the injection position.

Also shown in FIG. 3 are the injection valves 60, 62 which open as shown in FIG. 4 to allow fuel to be injected into the space between the projectile 50 and bolt 20.

The piston and valve arrangement shown provides for the introduction of two separate fluids from pressurized sources (not shown) through check valves 57, 59.

A piston 64 operating in cylinder 66 is provided for moving the bolt driver 22 and bolt 20. Fluid pressure from a hydraulic source (not shown) supplies operating pressure to one side or the other of piston 64 through ports 68 and 70.

By controlling the hydraulic pressure to piston 64 and piston 44 by conventional operating means, the following sequence of operation may be easily achieved.

OPERATION

A typical cycle of operation starts with the bolt 20 in its extreme rearward or OPEN position as indicated in FIG. 3. The projectile 50 is then loaded into the chamber through magazine 18, for example, and the bolt is moved to the position shown in FIG. 4. This position is gaged by the cam follower 26 in conjunction with cam 32 as shown in FIGS. 1 and 2.

During movement of the bolt 20 from the FIG. 3 position to the FIG. 4 position, the injection valves 60, 62 remain in the closed position shown in FIG. 3. In this position the valves prevent passage of fluid into the gun chamber until a predetermined pressure has been reached. At this time in the operation, however, the cylinders 52, 54 are filled with their respective fluids under pressure from their associated accumulators (not shown) through their respective check valves 57, 59.

After the bolt has been moved to the FIG. 4 position, the yoke 33 is moved upwardly by hydraulic action through port 58 to move piston 44. This action causes a rise in pressure in cylinders 52, 54 by action of pistons 40, 42 respectively. The injector valves 60, 62 are designed to open suddenly when the fluid pressure exceeds a predetermined threshold value. The threshold pressure necessary to "pop" the valves may be determined by a valve return system as shown at 68 in FIG. 6.

When the valves open propellant mixes and flows between the bolt 20 and projectile 50. Near the limit of travel of the propellant pump system, the pump piston 42 engages the lower surface of valve member 60 moving it toward a closed position. As valve member 60 moves upward as shown in FIG. 4 fuel pressure increases on valve member 62 and causes this valve to move into a closed position and, with both valves closed, a smooth surface is presented within the gun bore.

Figure 5:
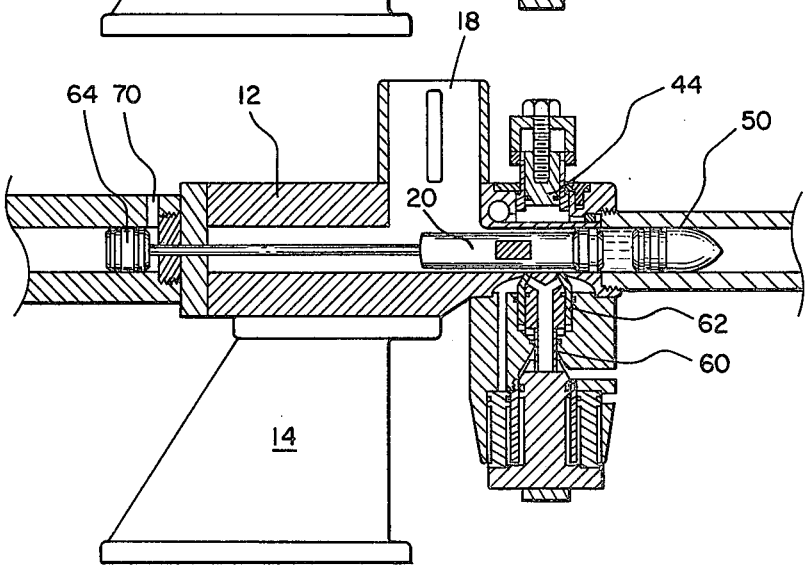
FIG. 5 is a view similiar to FIG. 3 with the bolt in FIRE position.

At this time the cam 32 has moved out of line with cam follower 26 allowing the bolt face to move across the closed injector ports into its firing position shown in FIG. 5. This position is sufficiently forward of the injector port to insure that the injector will be free from breech pressure.

Figure 6:
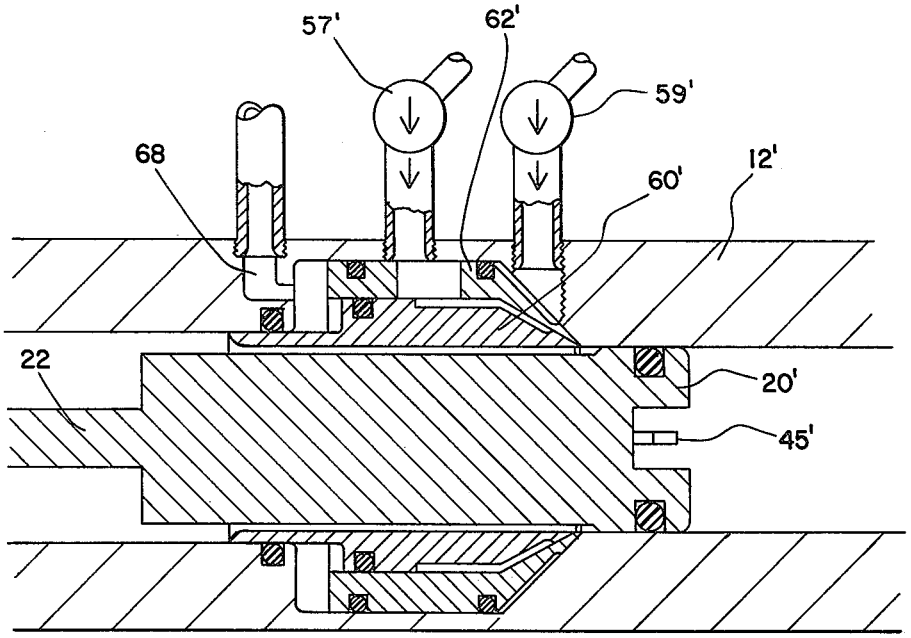
FIG. 6 is a longitudinal cross-sectional view of a concentric or axial arrangement of the valves with respect to the bore.

At this point the spark ignitor 45 recessed in the front face of the bolt, as shown in FIG. 2 or as 45' in FIG. 6 is activated and burning of the propellant causes a sudden pressure increase driving the projectile out of the gun.

To complete the cycle, the bolt is withdrawn along with cam follower 26 allowing the pumping mechanism 30 to return to its original position a new projectile 50 is dropped into position and the cycle is ready to repeat.

Figure 7:
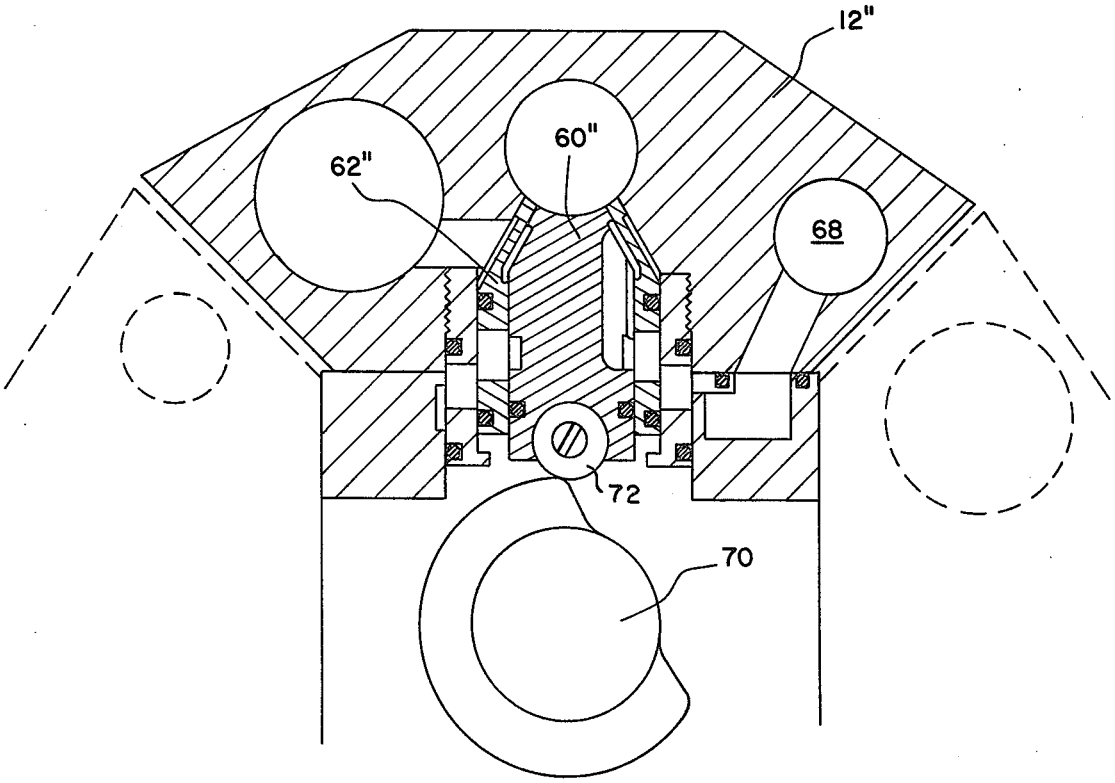
FIG. 7 is a cross-sectional view of a multi-barrel radial configuration

In the embodiments shown in FIGS. 6 and 7, identical parts have been given identical numbers and like parts have been given like numbers with primes or double primes.

The embodiment shown in FIG. 6 illustrates the injector valves 60', 62' co-axial with barrel 12'. In this embodiment the bolt 20' passes through the fuel control valves 60', 62'. Valve closing in this embodiment can be effected by hydraulic pressure through port 68 or by direct contact with the bolt.

The fuel valving arrangement according to the present invention may also be utilized in a multi-barrel embodiment wherein the valves 60'', 62'' associated with plural barrels 12'' are actuated by a rotary cam 70 acting upon each cam follower 72 as shown in FIG. 7.

We claim:

1. In a liquid propellant gun, the combination comprising;

a composite block including an intermediate section, a forward section, and a rearward section;

said forward section and said rearward section having axial aligned bores therethrough;

a gun barrel attached to said forward section having a bore co-axial with said aligned bores;

a bolt in said rearward section closely fitted for sliding movement within the said bore therethrough;

said intermediate section including an opening communicating with said aligned bores;

fuel supply means communicating with said opening;

valve means in said opening movable from a first position admitting fuel to said aligned bores and a second position fully closing said opening and forming a smooth wall portion in alignment with the walls of said bores;

said rearward section also including an opening for admitting projectiles in front of said bolt;

means for moving said bolt rearwardly to allow introduction of a projectile and forwardly to position said projectile within said bores;

and means for introducing fuel between said projectile and said bolt when the projectile-bolt interface is presented athwart said opening in the intermediate section of said block.

2. The gun according to claim 1 wherein said valve means comprises a cylindrical valve slidably fitted in said opening.

3. The gun according to claim 1 wherein said means for introducing fuel further comprises a measured capacity fuel chamber communicating with each said valve in said opening and pump means effective to deliver fuel from each said chamber simultaneously through said valves and said opening into said bores and thereafter to effect closure of said valves.

4. The gun according to claim 1 wherein said valves have surfaces complementary to said bores so that, when said valves are moved to a position closing said opening thereto a substantially continuous smooth surface is formed.

5. The gun according to claim 4 wherein said means for introducing fuel further comprises a measured capacity fuel chamber communicating with each said valve in said opening and pump means effective to deliver fuel from said chamber simultaneously through said valves and said opening into said bores and thereafter to effect closure of said valves.

6. The gun according to claim 1 wherein said valves are biased toward a closed position and have a contour designed to react to applied pressure so that, when a predetermined liquid pressure is applied to said valves through said opening, the valves move suddenly from said second position to said first position admitting fuel to said aligned bores when said projectile-bolt interface is in position athwart said opening.

7. The gun according to claim 6 wherein said valves have surfaces complementary to said bores so that, when said valves are moved to a position closing said opening thereto a substantially continuous smooth surface is formed.

8. The gun according to claim 7 wherein said means for introducing fuel further comprises a measured capacity fuel chamber communicating with said valve in said opening and pump means effective to deliver fuel from each said chamber simultaneously through said valves and said opening into said bores and thereafter to effect closure of said valves.

9. The gun according to claim 1 wherein said valve means comprises two concentric cylindrical valves slidably mounted within said opening.

10. The gun according to claim 9 wherein said means for introducing fuel further comprises a measured capacity fuel chamber communicating with each said valve in said opening and pump means effective to deliver fuel from each said chamber simultaneously through said valves and said opening into said bores and thereafter to effect closure of said valves.

11. The gun according to claim 9 wherein said valves are biased toward a closed position and have a contour designed to react to applied pressure so that, when a predetermined liquid pressure is applied to said valves through said opening, the valves move suddenly from said second position to said first position admitting fuel to said aligned bores when said projectile-bolt interface is in position athwart said opening.

12. The gun according to claim 11 wherein said means for introducing fuel further comprises a measured capacity fuel chamber communicating with each said valve in said opening and pump means effective to deliver fuel from each said chamber simultaneously through said valves and said opening into said bores and thereafter to effect closure of said valves.

13. The gun according to claim 9 wherein said valves have a common longitudinal axis with said aligned bores.

14. The gun according to claim 13 wherein said valves have surfaces complementary to said bores so that, when said valves are moved to a position closing said opening thereto a substantially continuous smooth surface is formed.

15. The gun according to claim 13 wherein said valves are biased toward a closed position and have a contour designed to react to applied pressure so that, when a predetermined liquid pressure is applied to said valves through said opening, the valves move suddenly from said second position to said first position admitting fuel to said aligned bores when said projectile-bolt interface is in position athwart said opening.

16. The gun according to claim 15 wherein said valves have surfaces complementary to said bores so that, when said valves are moved to a positon closing said opening thereto, a substantially continuous smooth surface is formed.

17. The gun according to claim 9 wherein said valves have a longitudinal axis radial to the axis of said aligned bores.

18. The gun according to claim 17 including a plurality of barrels in said forward section aligned with a like plurality of bores in said rearward section and said intermediate section including a plurality of valve means arranged around a central chamber;

cam follower means on each said valve means; and rotary cam means acting successively on each said cam follower means to successively operate each said valve means in turn.

19. The gun according to claim 18 wherein said valves have surfaces complementary to said bores so that, when said valves are moved to a position closing said opening thereto a substantially continuous smooth surface is formed.

20. The gun according to claim 19 wherein said valves are biased toward a closed position and have a contour designed to react to applied pressure so that, when a predetermined liquid pressure is applied to said valves through said opening, the valves move suddenly from said second position to said first position admitting fuel to said aligned bores when said projectile-bolt interface is in position athwart said opening.

* * * * *